US012123632B2

(12) United States Patent
Zhu et al.

(10) Patent No.: US 12,123,632 B2
(45) Date of Patent: Oct. 22, 2024

(54) COMPRESSOR AND REFRIGERATION DEVICE

(71) Applicant: ANHUI MEIZHI PRECISION MANUFACTURING CO., LTD., Anhui (CN)

(72) Inventors: Xiaohan Zhu, Anhui (CN); Xingbiao Zhou, Anhui (CN); Bo Jiang, Anhui (CN); Shumin Lin, Anhui (CN); Qiang Gu, Anhui (CN)

(73) Assignee: ANHUI MEIZHI PRECISION MANUFACTURING CO., LTD., Anhui (CN)

( * ) Notice: Subject to any disclaimer, the term of this patent is extended or adjusted under 35 U.S.C. 154(b) by 389 days.

(21) Appl. No.: 17/535,799

(22) Filed: Nov. 26, 2021

(65) Prior Publication Data

US 2022/0082309 A1 Mar. 17, 2022

Related U.S. Application Data

(63) Continuation of application No. PCT/CN2020/100762, filed on Jul. 8, 2020.

(30) Foreign Application Priority Data

Nov. 29, 2019 (CN) ..... 201911205085.6

(51) Int. Cl.
*F25B 31/02* (2006.01)
*F04C 18/04* (2006.01)
(Continued)

(52) U.S. Cl.
CPC ..... *F25B 31/023* (2013.01); *F04C 18/04* (2013.01); *F04C 27/001* (2013.01); *F04C 29/12* (2013.01);
(Continued)

(58) Field of Classification Search
CPC .. F25B 31/023; F25B 5/02; F25B 6/02; F04C 18/04; F04C 27/001; F04C 29/12;
(Continued)

(56) References Cited

U.S. PATENT DOCUMENTS

2009/0013714 A1* 1/2009 Yamaguchi ..... F04C 18/02 62/510
2011/0150683 A1* 6/2011 Lee ..... F04C 18/356 418/5
(Continued)

FOREIGN PATENT DOCUMENTS

CN 205858676 U 1/2017
CN 107476979 A 12/2017
(Continued)

OTHER PUBLICATIONS

First Office Action dated Mar. 26, 2021 received in Chinese Patent Application No. CN 201911205085.6 together with an English language translation.
(Continued)

*Primary Examiner* — Kun Kai Ma
(74) *Attorney, Agent, or Firm* — Scully, Scott, Murphy & Presser, P.C.

(57) ABSTRACT

A compressor and a refrigeration device are provided. The compressor has a housing, a first cylinder, a first piston, a second cylinder and a second piston. The housing has a first air outlet port and a second air outlet port. The first cylinder has an accommodating cavity, and the first piston is eccentrically disposed in the first accommodating cavity. The second cylinder has a second accommodating cavity, and the second piston is eccentrically disposed in the second accommodating cavity.

13 Claims, 10 Drawing Sheets

(51) Int. Cl.

| | |
|---|---|
| ***F04C 27/00*** | (2006.01) |
| ***F04C 29/12*** | (2006.01) |
| ***F25B 5/02*** | (2006.01) |
| ***F25B 6/02*** | (2006.01) |

(52) U.S. Cl.
CPC ..... *F25B 5/02* (2013.01); *F25B 6/02* (2013.01); *F25B 2400/06* (2013.01)

(58) Field of Classification Search
CPC ..... F04C 2400/06; F04C 29/124; F04C 2240/30; F04C 29/00; F04C 2240/10; F04C 2240/20; F04C 2240/50; F04C 29/0085
See application file for complete search history.

(56) References Cited

U.S. PATENT DOCUMENTS

| | | | | |
|---|---|---|---|---|
| 2011/0179822 | A1* | 7/2011 | Sotojima | F04C 28/02 62/510 |
| 2017/0108246 | A1* | 4/2017 | Xiang | F04B 25/005 |
| 2017/0350394 | A1* | 12/2017 | Ashimori | F04C 23/001 |
| 2018/0156215 | A1* | 6/2018 | Yang | F04C 23/008 |
| 2021/0404458 | A1* | 12/2021 | Frank | F04B 27/02 |
| 2022/0082309 | A1* | 3/2022 | Zhu | F04C 27/001 |

FOREIGN PATENT DOCUMENTS

| | | | |
|---|---|---|---|
| CN | 107489620 | A | 12/2017 |
| CN | 107859623 | A | 3/2018 |
| CN | 108119955 | A | 6/2018 |
| CN | 207437362 | U | 6/2018 |
| CN | 109058106 | A | 12/2018 |
| CN | 208749557 | U | 4/2019 |
| CN | 110821833 | A | 2/2020 |
| CN | 110985384 | A | 4/2020 |
| JP | 2008-057395 | A | 3/2008 |

OTHER PUBLICATIONS

Second Office Action dated Jun. 11, 2021 received in Chinese Patent Application No. CN 201911205085.6 together with an English language translation.
Decision of Rejection dated Sep. 15, 2021 received in Chinese Patent Application No. CN 201911205085.6 together with an English language translation.
Decision of Refusal dated May 23, 2023 received in Japanese Patent Application No. JP 2021-570963.
Request for the Submission of an Opinion dated Nov. 22, 2022 received in Korean Patent Application No. KR 10-2021-7039016.
International Search Report dated Oct. 12, 2020 received in International Application No. PCT/CN2020/100762 together with an English language translation.
Decision of Reexamination dated Aug. 29, 2023 received in Chinese Patent Application No. CN 201911205085.6.
Supplementary European Search Report dated Oct. 13, 2022 received in European patent Application No. EP 20892459.7.
Office Action dated Jun. 26, 2024 received in European Patent Application No. EP 20892459.7.

* cited by examiner

COMPRESSOR AND REFRIGERATION DEVICE

CROSS-REFERENCE TO RELATED APPLICATIONS

The present application is a continuation application of PCT International Application No. PCT/CN2020/100762, filed on Jul. 8, 2020, which claims priority to and benefits of Chinese Patent Application No. 201911205085.6 filed with China National Intellectual Property Administration on Nov. 29, 2019 and entitled "Compressor and Refrigeration Device", the entire contents of which are incorporated herein by reference for all purposes. No new matter has been introduced.

FIELD

The present application relates to the technical field of refrigeration device, and particularly relates to a compressor and a refrigeration device having the compressor.

BACKGROUND

In the related art, a double-cylinder compressor means that two cylinders are disposed in an axial direction of a crankshaft, and processes of suction, compression and exhausting of a refrigerant can be realized in both cylinders, and the refrigerant is discharged out of a housing through different air outlet channels, thereby realizing double-pressure exhausting of the compressor.

However, in view of the considerations such as processing convenience and assembly simplicity, the displacement of each cylinder of the current double-cylinder compressor is equal. However, under the demand for the compressor with double exhaust pressures, condenser temperatures corresponding to different pressure ratios are different, enthalpy differences at an inlet and an outlet are different, and corresponding flow rates are also different. In fact, exhausting of the compressor with the equal displacement cannot fully utilize double exhaust advantages, and the optimal effect cannot be achieved.

SUMMARY

The present application aims to solve one of the technical problems existing in the prior art or the related art.

To this end, a first aspect of the present application provides a compressor.

A second aspect of the present application provides refrigeration device.

According to the first aspect of the present application, a compressor is provided. The compressor comprises a housing, a first cylinder and a first piston, and a second cylinder and a second piston. A first air outlet port and a second air outlet port that do not communicate with each other are disposed in the housing. The first cylinder is provided with a first accommodating cavity, and the first piston is eccentrically disposed in the first accommodating cavity. The second cylinder is provided with a second accommodating cavity, and the second piston is eccentrically disposed in the second accommodating cavity. According to an embodiment, the inner diameter of the first cylinder is D1, an eccentric distance of the first piston relative to the first accommodating cavity is e1, the height of the first cylinder is H1, and an exhaust pressure of the first cylinder is P1; and the inner diameter of the second cylinder is D2, an eccentric distance of the second piston relative to the second accommodation cavity is e2, the height of the second cylinder is H2, and an exhaust pressure of the second cylinder is P2, wherein $P1<P2$, $0.6<(e1\times(D1-e1)\times H1)\div(e2\times(D2-e2)\times H2)\leq 1.9$.

The compressor provided by the embodiments comprises the first cylinder, the first piston, the second cylinder and the second piston. The first cylinder is provided with the accommodating cavity by processing, the first piston is eccentrically disposed in the first accommodating cavity, and the second piston is eccentrically disposed in the second accommodating cavity, and the first piston can reciprocate in the first accommodating cavity, so that the first piston can realize suction, compression and exhausting of gas by changing the volume of a first working cavity. The first working cavity belongs to a part of the first accommodating cavity and is enclosed by the peripheral face of the first piston, a first slide sheet assembly and the first cylinder. The second piston can make reciprocating motion in the second accommodation cavity, thereby realizing processes of air suction, air compression and gas exhausting by changing the volume of a second working cavity. The second working cavity belongs to a part of the second accommodation cavity and is enclosed by the peripheral surface of the second piston, the second slide sheet assembly and the inner surface of the second cylinder. The two cylinders and two pistons are disposed to realize a double exhaust function, and both the first cylinder and the second cylinder can realize the processes of suction, compression and exhausting of a refrigerant. The arrangement mode avoids the problem of high cost caused by arranging multiple compressors to realize the double exhaust function in the related art. One compressor in the present application can realize the function that need to be realized by two compressors in the related art, which reduces processing cost and occupied space of the compressor, and is conducive to improving convenience of a compressor installation process.

In addition, the exhaust pressures of the first cylinder and the second cylinder in the present application are defined to be different, which can make the time for the refrigerant to reach a predetermined temperature and required energy be different. It can be understood that the first cylinder and the second cylinder realize different exhaust pressures according to the different use requirements of the compressor, so that condensers corresponding to the first cylinder and the second cylinder can efficiently realize a condensation function, energy wasting is avoided, double exhaust advantages of the double-cylinder compressor are fully used, and the energy efficiency of the compressor is significantly improved.

In addition, by limiting $P1<P2$, and the purpose of different exhaust pressures of the first cylinder and the second cylinder is achieved. By limiting the inner diameter of the first cylinder to be different from that of the second cylinder, the eccentric distance of the first piston relative to the first accommodating cavity is different from that of the second piston relative to the second accommodating cavity, the height of the first cylinder is different from that of the second cylinder, and the specific range is $0.6\leq(e1\times(D1-e1)\times H1)\div(e2\times(D2-e2)\times H2)\leq 1.9$, which can realize that the exhaust pressure of the first cylinder is different from that of the second cylinder, and meanwhile, the displacement of the first cylinder is different from that of the second cylinder, so that condensers corresponding to the first cylinder and the second cylinder can efficiently realize a condensation function, energy wasting is avoided, double exhaust advantages of the double-cylinder compressor are fully used, and the energy efficiency of the compressor and refrigeration device applying the compressor is significantly improved.

It should be noted that the eccentric distance of the first piston relative to the first accommodation cavity in the present application is the eccentric distance of the first piston relative to a center line of the first accommodation cavity by default, and an extension direction of the center line is the same as an axial direction of a crankshaft. The eccentric distance of the second piston relative to the second accommodation cavity is the eccentric distance of the second piston relative to a center line of the second accommodation cavity by default, and an extension direction of the center line is the same as the axial direction of the crankshaft. The first accommodating cavity is cylindrical or roughly cylindrical, and the second accommodating cavity is cylindrical or roughly cylindrical.

According to certain embodiments, the compressor further comprises a first bearing and a second bearing, wherein the first bearing and the second bearing are distributed at an interval, and the first cylinder and the second cylinder are positioned between the first bearing and the second bearing; a diaphragm assembly located between the first cylinder and the second cylinder; a first slide sheet assembly disposed in the first accommodating cavity, wherein the first slide sheet assembly, the peripheral surface of the first piston and the inner surface of the first cylinder enclose a first working cavity; a second slide sheet assembly disposed in the second accommodating cavity, wherein the second slide sheet assembly, the peripheral surface of the second piston and the inner surface of the second cylinder enclose a second working cavity; and a first exhaust outlet and a second exhaust outlet, wherein the first working cavity is communicated with the first air outlet port through the first exhaust outlet, and the second working cavity is communicated with the second air outlet port through the second exhaust outlet.

According to certain embodiments, the compressor also comprises a first bearing, a second bearing and a diaphragm assembly, wherein the first bearing can support the crankshaft, and the second bearing can support the first cylinder and the second cylinder, thus improving the installation stability of the first cylinder and the second cylinder. The diaphragm assembly is disposed between the first cylinder and the second cylinder, which are also disposed between the first bearing and the second bearing, so that the first bearing and the diaphragm assembly can block the first accommodation cavity of the first cylinder between them, and the second bearing and diaphragm assembly can block the second accommodation cavity of the second cylinder between them. The first slide sheet assembly, the peripheral surface of the first piston and the inner surface of the first cylinder enclose the first working cavity, while the second slide sheet assembly, the peripheral surface of the second piston and the inner surface of the second cylinder enclose the second working cavity. By motion, the first piston can change the volume of the first working cavity to compress gas. By motion, the second piston can change the volume of the second working cavity to compress gas. The compressor further comprises the first exhaust outlet and the second exhaust outlet. The first exhaust outlet is communicated with the first working cavity and the first air outlet port, and the second exhaust outlet is communicated with the second working cavity and the second air outlet port.

Further, the first bearing and the diaphragm assembly abut against the first cylinder, and the second bearing and the diaphragm assembly abut against the second cylinder.

According to certain embodiments, the first exhaust outlet is communicated with the first air outlet port through the inner cavity of the housing, or the second exhaust outlet is communicated with the second air outlet port through the inner cavity of the housing. Further, the first exhaust outlet is disposed on the first cylinder or the first bearing or the diaphragm assembly; and the second exhaust outlet is disposed on the second cylinder or the second bearing or the diaphragm assembly.

According to certain embodiments, the first exhaust outlet is communicated with the first air outlet port through the inner cavity of the housing, so that gas in the first working cavity is discharged through the first exhaust outlet, diffused into the inner cavity of the housing and then discharged through the first air outlet port. The exhaust pressure of the first cylinder is less than that of the second cylinder, so that the gas pressure in the inner cavity of the housing is relatively low, which is convenient for the compressor to get oil returned and beneficial to ensuring the reliability of compressor running.

According to certain embodiments, it is also possible to make the second exhaust outlet communicate with the second air outlet port through the inner cavity of the housing, so that gas in the second working cavity will be diffused into the inner cavity of the housing after being discharged through the second exhaust outlet, and then be discharged through the second air outlet port.

In addition, the first exhaust outlet may be disposed on the first cylinder or the first bearing or the diaphragm assembly; and the second exhaust outlet may also be disposed on the second cylinder or the second bearing or the diaphragm assembly.

It should be noted that in the present application, the inner cavity of the housing refers to spare space in the housing.

According to certain embodiments, the compressor further comprises a first seal and a first air outlet channel. The first seal and the first bearing enclose a first exhaust cavity, and the first exhaust outlet is communicated with the first exhaust cavity; the first air outlet channel penetrates through the first bearing, the first cylinder, the diaphragm assembly, the second cylinder and the second bearing and is communicated with the inner cavity of the housing. The compressor further comprises a second seal and a second air outlet channel. The second seal and the second bearing enclose a second exhaust cavity, the second exhaust outlet is communicated with the second exhaust cavity, the second exhaust channel penetrates through the second bearing, the second cylinder and the diaphragm assembly and is communicated with the second air outlet port through an exhaust channel on the first cylinder.

According to certain embodiments, the compressor further comprises a first seal, a first air outlet channel, a second seal and a second air outlet channel. The first seal and the first bearing enclose a first exhaust cavity, and the second seal and the second bearing enclose a second exhaust cavity. The first working cavity is communicated with the first air outlet channel, and the first air outlet channel penetrates through the first bearing, the first cylinder, the diaphragm assembly, the second cylinder and the second bearing, and then is communicated with the inner cavity of the housing, so that gas in the first working cavity can reach the side where the second cylinder is located through the first air outlet channel, and is then diffused into the inner cavity of the housing to communicate with the first air outlet port. By communicating the second working cavity with the second air outlet channel which is made to penetrate through the second bearing, the second cylinder and the diaphragm assembly, and then communicate with the second air outlet port through the exhaust channel on the first cylinder, it is realized that gas in the second working cavity moves to the position where the first cylinder is located through the second air outlet channel and is discharged to the second air outlet port through an exhaust channel on the first cylinder.

Further, the first seal and the second seal are cover plates or silencers, which are connected at other positions by bolts or welding.

According to certain embodiments, the compressor further comprises a first exhaust valve disposed on the first air outlet channel; and a second exhaust valve disposed on the second air outlet channel. The first exhaust valve can conduct and block the first air outlet channel, and the second exhaust valve can conduct and block the second air outlet channel.

According to certain embodiments, the housing is provided with an air suction port, and the compressor further comprises a first air suction channel and a second air suction channel. The first working cavity is communicated with the air suction port through the first air suction channel, and the second working cavity is communicated with the air suction port through the second air suction channel. Further, the first air suction channel and the second air suction channel are communicated with each other.

According to certain embodiments, an air suction port may be disposed on the housing, so that both the first working cavity and the second working cavity communicate with one air suction port. For example, the first working cavity is communicated with the air suction port through a first air suction channel, and the second working cavity is communicated with the air suction port through a second air suction channel, and the first air suction channel and the second air suction channel are optionally communicated with each other, so that the total length of the air suction channel is reduced, the rigidity is prevented from being influenced by over-machining parts such as cylinders and bearings, and the production cost is reduced.

According to certain embodiments, the housing is provided with two air suction ports, and the compressor further comprises a first air suction channel and a second air suction channel. The first working cavity is communicated with one air suction port through the first air suction channel, and the second working cavity is communicated with the other air suction port through the second air suction channel. Further, the first air suction channel and the second air suction channel do not communicate with each other.

According to certain embodiments, by setting the two air suction ports on the housing and making one working cavity communicate with one air suction port, the gases in the two air suction channels will not be mixed with each other, which is beneficial to ensure the suction amount of each cylinder.

According to certain embodiments, the first air suction channel is disposed on the first cylinder or the first bearing or the diaphragm assembly; and the second air suction channel is disposed on the second cylinder or the second bearing or the diaphragm assembly.

Further, the first air suction channel is disposed on the first cylinder, and gas enters the first working cavity through the first air suction channel and is compressed in the first working cavity. Similarly, the first air suction channel can also be disposed on the first bearing, and the gas enters the first working cavity through the first air suction channel on the first bearing, thus realizing the process of sucking the gas into the first working cavity. The second air suction channel is disposed on the second cylinder, and the gas enters the second working cavity through the second air suction channel and is compressed in the second working cavity. Similarly, the second air suction channel can also be disposed on the second bearing, and the gas enters the second working cavity through the second air suction channel on the second bearing, thus realizing the process of sucking the gas into the second working cavity.

According to certain embodiments, the first slide sheet assembly comprises a first slide sheet and a first elastic part. The first elastic part is used for pushing the first slide sheet to press the peripheral surface of the first piston; or the first slide sheet component comprises a first slide sheet, and the first slide sheet and the first piston are in an integrated structure; or the first slide sheet and the first piston are hinged.

According to certain embodiments, the first slide sheet assembly comprises a first slide sheet and a first elastic part. The first slide sheet presses the peripheral surface of the first piston, and the first elastic part is connected with the end of the first slide sheet which is far away from the first piston, so that the first elastic part can push the first slide sheet to press the peripheral surface of the first piston all the time during the motion of the first piston, thus ensuring the tightness of the first working cavity. Or, the first slide sheet assembly comprises a first slide sheet, and the first slide sheet can be integrated with the first piston, which can prevent the first slide sheet from falling out of a first slide sheet slot, ensure the stable installation of the first slide sheet, and improve the reliability of the product. Moreover, the integrated structure has good mechanical properties, so the connection strength between the first slide sheet and the first piston can be improved. In addition, the first slide sheet and the first piston are integrally made, which is beneficial to mass production, improves the processing efficiency of a product and reduces the processing cost of the product.

According to certain embodiments, the first slide sheet can also be hinged with the first piston, which can also play a role in preventing the first slide sheet from falling out of the first slide sheet slot, thereby stabilizing the installation of the first slide sheet and improving the reliability of the product.

According to certain embodiments, the second slide sheet assembly comprises a second slide sheet and a second elastic part. The second elastic part is used for pushing the second slide sheet to press the peripheral surface of the second piston. Or the second slide sheet assembly comprises a second slide sheet. The second slide sheet and the second piston are in an integrated structure or the second slide sheet and the second piston are hinged.

According to certain embodiments, the second slide sheet assembly comprises a second slide sheet and a second elastic part. The second slide sheet presses the peripheral surface of the second piston, and the second elastic part is connected with the end of the second slide sheet which is far away from the second piston, so that the second elastic part can push the second slide sheet to press the peripheral surface of the second piston all the time during the motion of the second piston, thus ensuring the tightness of the second working cavity. Or, the second slide sheet assembly comprises a second slide sheet, and the second slide sheet can be integrated with the second piston, which can prevent the second slide sheet from falling out of a second slide sheet slot, ensure the stable installation of the second slide sheet, and improve the reliability of the product. Moreover, the integrated structure has good mechanical properties, so the connection strength between the second slide sheet and the second piston can be improved. In addition, the second slide sheet and the second piston are integrally manufactured, which is beneficial to mass production, improves the processing efficiency of the product and reduces the processing cost of the product. Of course, the second slide sheet can also be hinged with the second piston, which can also play a role in preventing the second slide sheet from falling out of the second slide sheet slot, thereby stabilizing the installation of the second slide sheet and improving the reliability of the product.

According to certain embodiments, the compressor further comprises a crankshaft with a first eccentric part and a second eccentric part. The first piston is connected with the first eccentric part and the second piston is connected with the second eccentric part. The compressor further comprises a motor assembly which is connected with the crankshaft to drive the crankshaft to rotate.

According to certain embodiments, the compressor further comprises a crankshaft and a motor assembly, which can drive the crankshaft to rotate, and the first eccentric part on the crankshaft is connected with the first piston, so that when the crankshaft rotates, the first eccentric part on the crankshaft drives the first piston to rotate, and the rotating first piston realizes functions of sucking, compressing and discharging gas. Similarly, the second eccentric part on the crankshaft is connected with the second piston, so that when the crankshaft rotates, the second eccentric part on the crankshaft drives the second piston to rotate, and the rotating second piston realizes the functions of sucking, compressing and discharging the gas.

The embodiments of the second aspect of the present application propose refrigeration device, which comprises the compressor according to any of the above embodiments, so the refrigeration device provided by the present application has all the benefits of the compressor provided in any of the above embodiments.

According to certain embodiments, the refrigeration device further comprises a first condenser communicated with the first air outlet port of the compressor; a first throttling part communicated with the first condenser; a first evaporator communicated with the first throttling part; a first reservoir communicated with the first evaporator and the first air suction channel of the compressor; a second condenser communicated with a second air outlet port of the compressor; a second throttling part communicated with the second condenser; a second evaporator communicated with the second throttling part; and a second reservoir communicated with the second evaporator and the second air suction channel of the compressor.

According to certain embodiments, the compressor, the first condenser, the first throttling part, the first evaporator and the first reservoir form a first set of refrigeration system, while the compressor, the second condenser, the second throttling part, the second evaporator and the second reservoir form a second set of refrigeration system. The two independent refrigeration systems, i.e., the refrigeration device realizes multi-exhaust functions realized by multiple compressors in the related art through one compressor, which reduces the processing cost of the refrigeration device and also reduces the occupied space of refrigeration device, and improves the convenience of installing internal components of refrigeration device. Due to the different exhaust pressures of the first cylinder and the second cylinder, the exhaust pressures reaching the first condenser and the second condenser are different, which can make the refrigeration device have double condensation temperatures and double evaporation temperatures. It is beneficial to realizing cascade utilization of energy and improving the energy efficiency of refrigeration device. Under the condition that the displacements of the first cylinder and the second cylinder are different, the amounts of refrigerant condensed by the first condenser and the second condenser are different, and the energy efficiency of refrigeration device is further improved.

According to certain embodiments, the refrigeration device further comprises a third condenser communicated with the first air outlet port of the compressor; a third throttling part communicated with the third condenser; a third evaporator communicated with the third throttling part; a third reservoir communicating the first air suction channel and the second air suction channel of the third evaporator and the compressor; a fourth condenser communicated with the second air outlet port of the compressor; a fourth throttling part communicated with the fourth condenser; a fourth evaporator communicated with the fourth throttling part; and the third reservoir is also communicated with the first air suction channel and the second air suction channel of the fourth evaporator and the compressor.

According to certain embodiments, the compressor, the third condenser, the third throttling part, the third evaporator and the third reservoir form a third set of refrigeration system, while the compressor, the fourth condenser, the fourth throttling part, the fourth evaporator and the third reservoir form a fourth set of refrigeration system. The two independent refrigeration systems, i.e., the refrigeration device realizes the multi-exhaust function realized by multiple compressors in the related art through one compressor, which reduces the processing cost of the refrigeration device and also reduces the occupied space of refrigeration device, and improves the convenience of installing internal components of refrigeration device. The first air suction channel and the second air suction channel communicate with the third reservoir, so that arrangement of one reservoir can meet the suction functions of the first cylinder and the second cylinder, the number of components in the refrigeration device is reduced, the processing cost of the refrigeration device is further reduced, the volume of the refrigeration device is effectively reduced, and the convenience in the installation of the refrigeration device is increased. Furthermore, due to the different exhaust pressures of the first cylinder and the second cylinder, the exhaust pressures reaching the third condenser and the fourth condenser are different, which can make the refrigeration device have double condensation temperatures and double evaporation temperatures, which is beneficial to realizing the cascade utilization of energy and improving the energy efficiency of the refrigeration device. Especially, under the condition that the displacements of the first cylinder and the second cylinder are different, the amounts of refrigerant condensed by the third condenser and the fourth condenser are different, and the energy efficiency of the refrigeration device is further improved.

Additional aspects and advantages of the present application will become apparent in the following description, or may be learned by practice of the present application.

BRIEF DESCRIPTION OF THE DRAWINGS

The above and/or additional aspects and advantages of the present application would become apparent and understandable in the description of embodiments in combination with the following figures, wherein.

Figure 1:
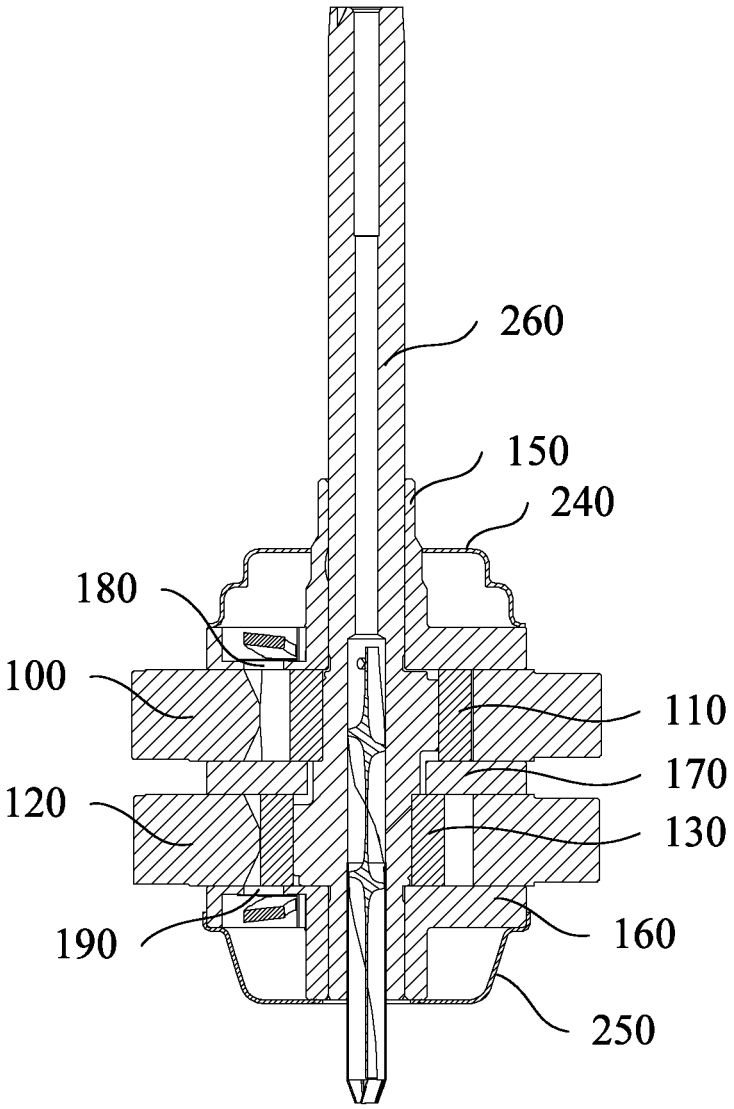
FIG. 1 shows a partial structural diagram of a compressor according to an embodiment of the present application.

Reference numerals and the components designated by the numerals, as shown in FIG. 1 to FIG. 11, are described as follows:

100 first cylinder, 110 first piston, 120 second cylinder, 130 second piston, 140 housing, 142 first air outlet port, 144 second air outlet port, 146 air suction port, 150 first bearing, 160 second bearing, 170 diaphragm assembly, 172 first diaphragm, 174 second diaphragm, 180 first exhaust outlet, 190 second exhaust outlet, 200 first air outlet channel, 210 second air outlet channel, 220 first air suction channel, 230 second air suction channel, 240 first seal, 242 first exhaust cavity, 250 second seal, 252 second exhaust cavity, 260 crankshaft, 270 motor assembly, 280 first slide sheet assembly, 290 second slide sheet assembly, 350 first condenser, 360 first evaporator, 370 first reservoir, 380 second condenser, 390 second evaporator, 400 second reservoir, 410 first throttling part, 420 second throttling part, 430 third condenser, 440 third evaporator, 450 third reservoir, 460 fourth condenser and 470 fourth evaporator.

DETAILED DESCRIPTION OF EMBODIMENTS

In order that the above objects, features and advantages of the present disclosure may be more clearly understood, the present disclosure is described in further detail below with reference to the accompanying drawings and detailed description. It should be noted that the embodiments and the features in the embodiments herein may be combined with one another without conflict.

In the following description, numerous specific details are set forth in order to provide a thorough understanding of the present disclosure. However, the present disclosure may be practiced otherwise than as described herein. Therefore, the scope of the present disclosure is not limited to the exemplary embodiments disclosed below.

A compressor and refrigeration device according to some embodiments of the present application will be described below with reference to FIG. 1 to FIG. 12.

Embodiment 1

Figure 6:
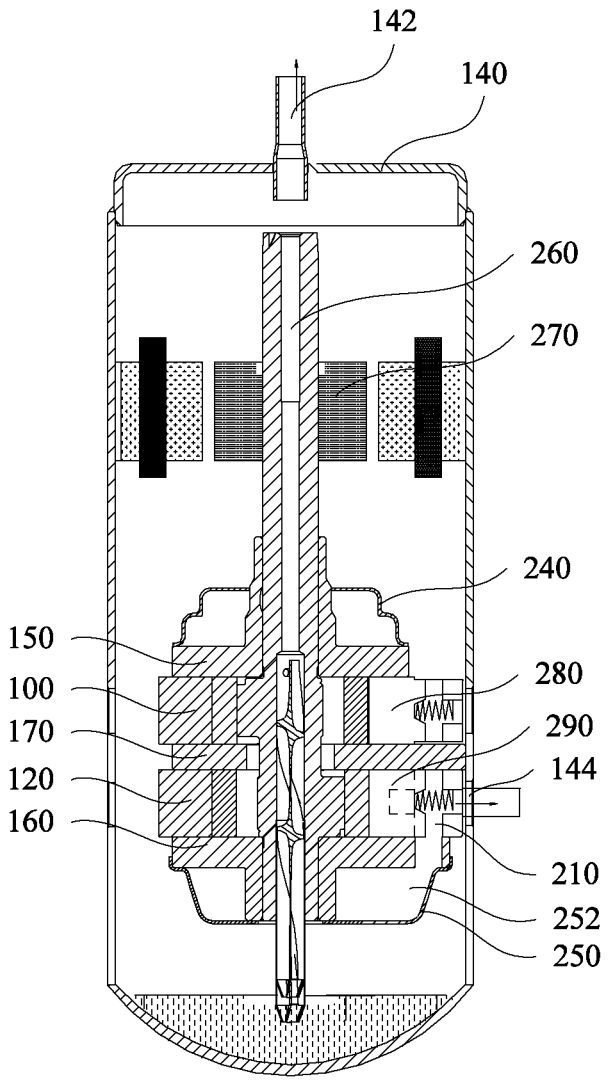
FIG. 6 shows a schematic structural diagram of a compressor according to further another embodiment of the present application.

A compressor, as shown in FIGS. 1 and 6, comprises a housing 140, a first cylinder 100, a first piston 110, a second cylinder 120 and a second piston 130. The housing 140 is provided with a first air outlet port 142 and a second air outlet port 144 which do not communicate with each other. The first cylinder 100 is provided with an accommodating cavity by processing, the first piston 110 is eccentrically disposed in the first accommodating cavity, the second cylinder 120 is also provided with an accommodating cavity, the second piston 130 is eccentrically disposed in the second accommodating cavity. The first piston 110 can reciprocate in the first accommodating cavity, so that the first piston 110 can realize the processes of air suction, air compression and gas exhausting by changing the volume of the first working cavity. The first working cavity belongs to a part of the first accommodating cavity and is enclosed by the peripheral face of the first piston 110, a first slide sheet assembly 280 and the first cylinder 100. The second piston 130 can reciprocate in the second accommodation cavity, so that the second piston 130 can realize the processes of air suction, air compression and gas exhausting by changing the volume of a second working cavity. The second working cavity belongs to a part of the second accommodation cavity and is enclosed by the peripheral surface of the second piston 130, the second slide sheet assembly 290 and the inner surface of the second cylinder 120. The first cylinder 100 exhausts gas through a first air outlet port 142 and the second cylinder 120 exhausts gas through a second air outlet port 144. A double exhaust function is realized by arranging the two cylinders and two pistons, and both the first cylinder 100 and the second cylinder 120 can realize the processes of suction, compression and exhausting of a refrigerant. The arrangement mode avoids the problem of high cost caused by arranging multiple compressors to realize the double exhaust function in the related art. One compressor in the present application can realize the function that need to be realized by two compressors in the related art, which reduces processing cost and occupied space of the compressor, and is conducive to improving convenience of a compressor installation process.

In addition, the exhaust pressures of the first cylinder 100 and the second cylinder 120 in the present application are defined to be different, which can make the time for the refrigerant to reach a predetermined temperature and required energy be different. It can be understood that the first cylinder 100 and the second cylinder 120 realize different exhaust pressures according to the different use requirements of the compressor, so that condensers corresponding to the first cylinder 100 and the second cylinder 120 can efficiently implement a condensation function, energy wasting can be reduced, double exhaust advantages of the double-cylinder compressor are fully used, and the energy efficiency of the compressor is significantly improved.

Further, in the present embodiment, $P1<P2$, $0.6\leq(e1\times(D1-e1)\times H1)\div(e2\times(D2-e2)\times H2)\leq 1.9$ are defined. For example, the value of $(e1\times(D1-e1)\times H1)\div(e2\times(D2-e2)\times H2)$ can be 0.8, 1.05 and 1.85. P1 is the exhaust pressure of the first cylinder 100, D1 is the inner diameter of first cylinder 100, e1 is the eccentric distance of first piston 110 relative to first cylinder 100, H1 is the height of first cylinder 100, P2 is the exhaust pressure of second cylinder 120, D2 is the inner diameter of second cylinder 120, e2 is the eccentric distance of second piston 130 relative to second cylinder 120, and H2 is the height of second cylinder 120. The ratio of e1×(D1−e1)×H1 to e2×(D2−e2)×H2 represents the ratio of the displacement of the first cylinder 100 to that of the second cylinder 120.

Figure 12:
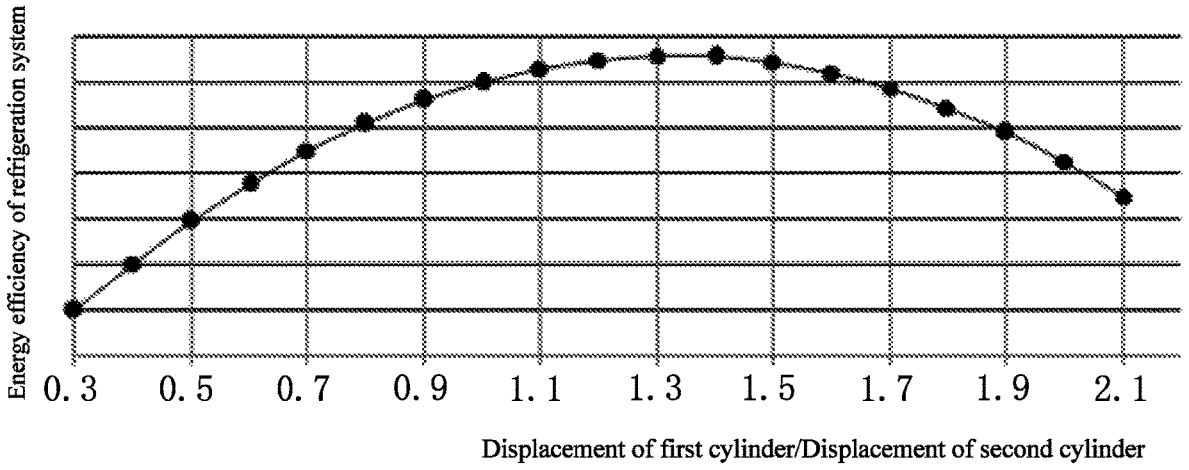
FIG. 12 is a schematic diagram showing a change curve of energy efficiency of refrigeration device according to an embodiment of the present application under a ratio of displacements of two cylinders.

As shown in FIG. 1 and FIG. 12, the present application defines that P1<P2, and the purpose of different exhaust pressures of the first cylinder 100 and the second cylinder 120 is achieved. By limiting that the inner diameter of the first cylinder 100 to be different from that of the second cylinder 120, the eccentric distance of the first piston 110 relative to the first accommodating cavity is different from that of the second piston 130 relative to the second accommodating cavity, the height of the first cylinder 100 is different from that of the second cylinder 120, and the specific range is $0.6 \leq (e1\times(D1-e1)\times H1)\div(e2\times(D2-e2)\times H2) \leq 1.9$, which can realize that the exhaust pressure of the first cylinder 100 is different from that of the second cylinder 120, and meanwhile, the displacement of the first cylinder 100 is different from that of the second cylinder 120, so that condensers corresponding to the first cylinder 100 and the second cylinder 120 can efficiently realize a condensation function, and energy wasting is avoided.

FIG. 12 is a schematic diagram showing a change curve of energy efficiency under different ratios of displacements. It can be seen from FIG. 12 that with the increase of the displacement ratio, the energy efficiency tends to increase at first and then decrease. Therefore, it can be seen that making full use of double exhaust advantages of the double-cylinder compressor can significantly improve the energy efficiency of the compressor and the refrigeration device using the compressor.

It should be noted that the eccentric distance of the first piston 110 relative to the first accommodation cavity in the present application is the eccentric distance of the first piston 110 relative to a center line of the first accommodation cavity by default, and an extension direction of the center line is the same as an axial direction of a crankshaft 260. The eccentric distance of the second piston 130 relative to the second accommodation cavity is the eccentric distance of the second piston 130 relative to a center line of the second accommodation cavity by default, and an extension direction of the center line is the same as the axial direction of the crankshaft 260. The first accommodating cavity is cylindrical or roughly cylindrical, and the second accommodating cavity is cylindrical or roughly cylindrical.

In addition, in the related art, in view of the considerations (such as, objects worked on by the compressor, acting objects, processing convenience and assembly simplicity), the displacement of each cylinder of the current double-cylinder compressor is equal. However, in the present application, due to different exhaust pressures of the first cylinder 100 and the second cylinder 120, condenser temperatures corresponding to different pressure ratios are different, enthalpy differences at an inlet and an outlet are different, and corresponding flow rates are also different, so that the advantages of double exhaust can be fully utilized to achieve the best effect.

Embodiment 2

Figure 4:
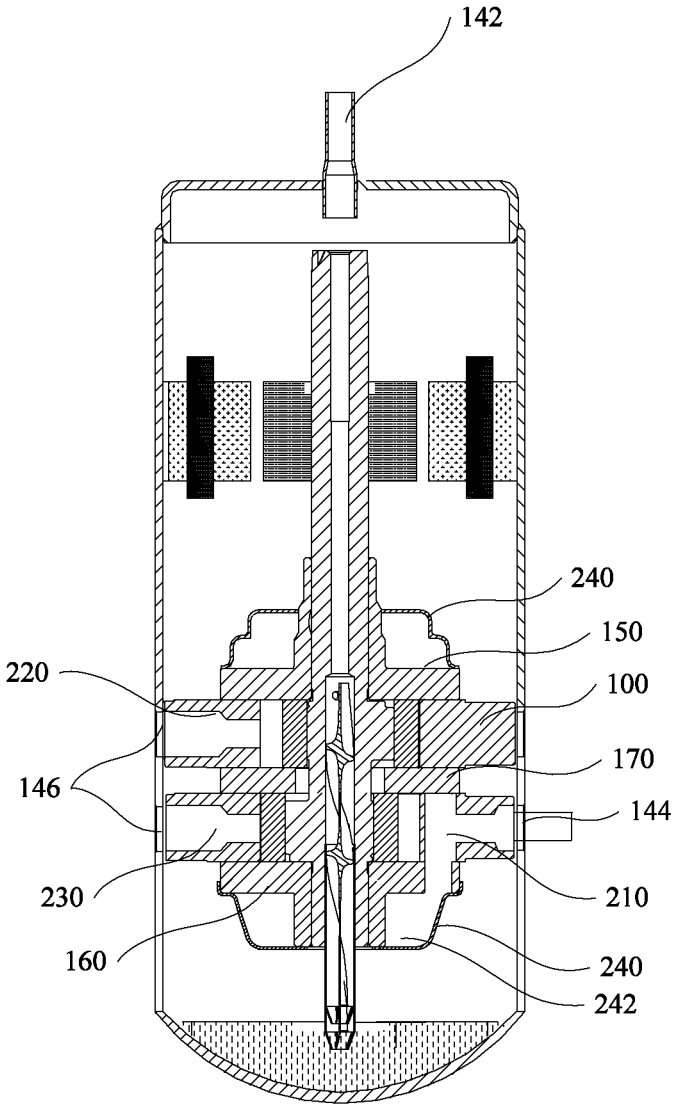
FIG. 4 shows a schematic structural diagram of a compressor according to further another embodiment of the present application.

With reference to FIG. 1, FIG. 4 and FIG. 6, on the basis of Embodiment 1, it is further defined that the compressor further comprises a first bearing 150, a second bearing 160, a diaphragm assembly 170, a first exhaust outlet 180, a second exhaust outlet 190, a first slide sheet assembly 280 and a second slide sheet assembly 290.

The first bearing 150 and the second bearing 160 are disposed at an interval, and the first cylinder 100 and the second cylinder 120 are located between the first bearing 150 and the second bearing 160. The first bearing 150 can support the crankshaft 260, and the second bearing 160 can support the first cylinder 100 and the second cylinder 120, thus improving the installation stability of the first cylinder 100 and the second cylinder 120.

The diaphragm assembly 170 is disposed between the first cylinder 100 and the second cylinder 120, which are also disposed between the first bearing 150 and the second bearing 160, so that the first bearing 150 and the diaphragm assembly 170 can block the first accommodation cavity of the first cylinder 100 between them, and the second bearing 160 and diaphragm assembly 170 can block the second accommodation cavity of the second cylinder 120 between them.

The first slide sheet assembly 280, the peripheral surface of the first piston 110 and the inner surface of the first cylinder 100 enclose the first working cavity, while the second slide sheet assembly 290, the peripheral surface of the second piston 130 and the inner surface of the second cylinder 120 enclose the second working cavity. The first piston 110 moves to change the volume of the first working cavity to compress gas. The second piston 130 moves to change the volume of the second working cavity to compress gas. The compressor further comprises the first exhaust outlet 180 and the second exhaust outlet 190, wherein the first exhaust outlet 180 is communicated with the first working cavity and the first air outlet port 142, and the second exhaust outlet 190 is communicated with the second working cavity and the second air outlet port 144, thus realizing the double-pressure exhaust function of the compressor.

Further, the first bearing 150 and the diaphragm assembly 170 abut against the first cylinder 100, and the second bearing 160 and the diaphragm assembly 170 abut against the second cylinder 120. The first working cavity is communicated with the first air outlet port 142 through the first exhaust outlet 180, and the second working cavity is communicated with the second air outlet port 144 through the second exhaust outlet 190.

Further, the first exhaust outlet 180 is disposed on the first cylinder 100 or the first bearing 150 or the diaphragm assembly 170; the second exhaust outlet 190 is disposed on the second cylinder 120 or the second bearing 160 or the diaphragm assembly 170; and the first exhaust outlet 180 is communicated with the first air outlet port 142 through the inner cavity of the housing 140, or the second exhaust outlet 190 is communicated with the second air outlet port 144 through the inner cavity of the housing 140.

In an exemplary embodiment, the first exhaust outlet 180 is disposed on the first cylinder 100, so that compressed gas in the first working cavity is exhausted through the first exhaust outlet 180; and the second exhaust outlet 190 is disposed on the second cylinder 120, so that compressed gas in the second working cavity is exhausted through the second exhaust outlet 190, which is convenient for exhausting the first working cavity and the second working cavity.

In another exemplary embodiment, the first exhaust outlet 180 and the second exhaust outlet 190 may also be disposed on the first bearing 150 and the second bearing 160, respectively.

As shown in FIG. 1, in an exemplary embodiment, the first bearing 150 is provided with a first exhaust outlet 180, so that compressed air in the first working cavity passes through the first exhaust outlet 180 on the first bearing 150. The second bearing 160 is provided with a second exhaust outlet 190, so that the compressed air in the second working cavity passes through the second exhaust outlet 190 on the second bearing 160. Since the first bearing 150 and the second bearing 160 are located on both sides of the two cylinders and are far away from each other, mutual influences of the exhaust processes of the first cylinder 100 and the second cylinder 120 are effectively avoided, and the double-pressure exhaust function of the compressor is realized.

Figure 2:
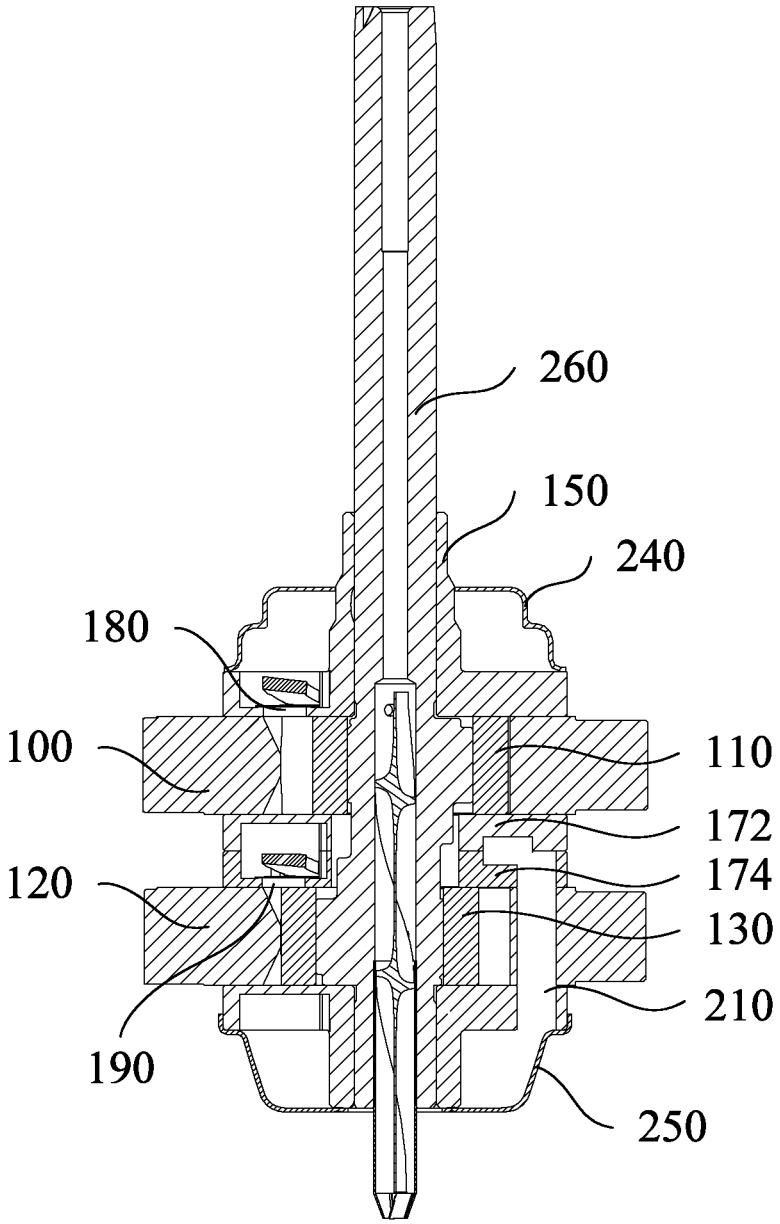
FIG. 2 shows a partial structural diagram of a compressor according to another embodiment of the present application.

As shown in FIG. 2, in another exemplary embodiment, the diaphragm assembly 170 comprises a first diaphragm 172 and a second diaphragm 174 which enclose a cavity, so that a second exhaust outlet 190 can be disposed on the second diaphragm 174, and compressed air in the second working cavity can be discharged into the cavity of the diaphragm assembly 170 through the second exhaust outlet 190. Then, the compressed air is discharged to the second air outlet port 144 through a second air outlet channel 210. At this time, the first bearing 150 is provided with the first exhaust outlet 180, and compressed air in the first working cavity can be discharged to the first air outlet port 142 through the first exhaust outlet 180, thus ensuring that the first cylinder 100 and the second cylinder 120 can realize an independent exhaust function and realize the double-pressure exhaust function of the compressor.

Figure 3:
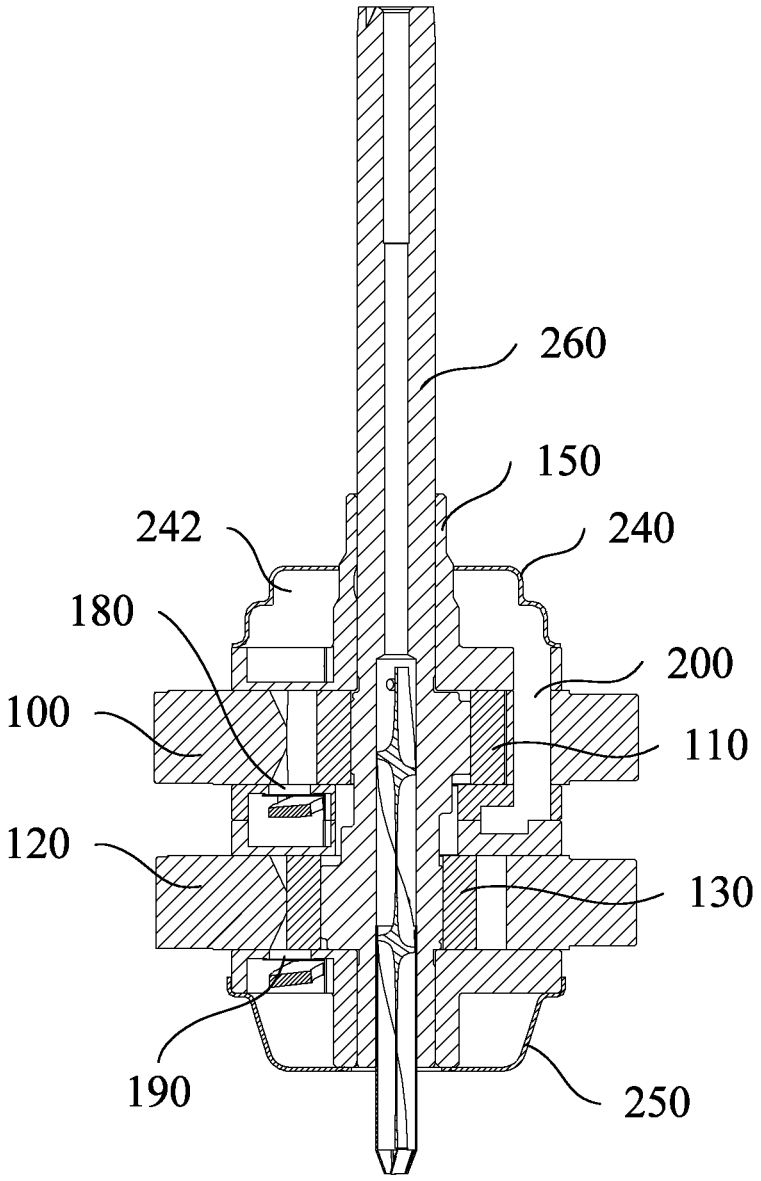
FIG. 3 shows a partial structural diagram of a compressor according to yet another embodiment of the present application.

As shown in FIG. 3, in yet another exemplary embodiment, the diaphragm assembly 170 comprises a first diaphragm 172 and a second diaphragm 174 which enclose a cavity, so that a first exhaust outlet 180 can be disposed on the first diaphragm 172, and compressed air in the first working cavity can be discharged into the cavity of the diaphragm assembly 170 through the first exhaust outlet 180. Then, the compressed air is discharged to the first air outlet port 142 through a first air outlet channel 200. At this time, the second bearing 160 is provided with the second exhaust outlet 190, and compressed air in the second working cavity can be discharged to the second air outlet port 144 through the second exhaust outlet 190, thus ensuring that the first cylinder 100 and the second cylinder 120 can realize an independent exhaust function and realize the double-pressure exhaust function of the compressor.

In further another exemplary embodiment, the diaphragm assembly 170 comprises a first diaphragm 172, a second diaphragm 174 and a diaphragm, and the diaphragm separates cavities in the first diaphragm 172 and the second diaphragm 174, thereby separating the cavities into two mutually independent cavities. At this time, the first diaphragm 172 may be provided with the first exhaust outlet 180, so that the compressed air in the first working cavity can be discharged to one of the cavities through the first exhaust outlet 180, and then discharged to the first air outlet port 142 through the first air outlet channel 200, or discharged to the first air outlet port 142 through the inner cavity of the housing 140. The second diaphragm 174 may also be provided with the second exhaust outlet 190, through which compressed air in the second working cavity is discharged to the other cavity, and then the compressed air is discharged to the second air outlet port 144 through the inner cavity of the housing 140 or discharged to the second air outlet port 144 through the second air outlet channel 210. It ensures that the exhausting processes of the first cylinder 100 and the second cylinder 120 do not affect each other, and realizes the double-pressure exhaust function of the compressor.

Figure 5:
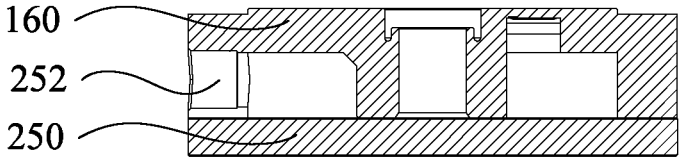
FIG. 5 shows a partial structural diagram of a compressor according to further another embodiment of the present application.
Figure 8:
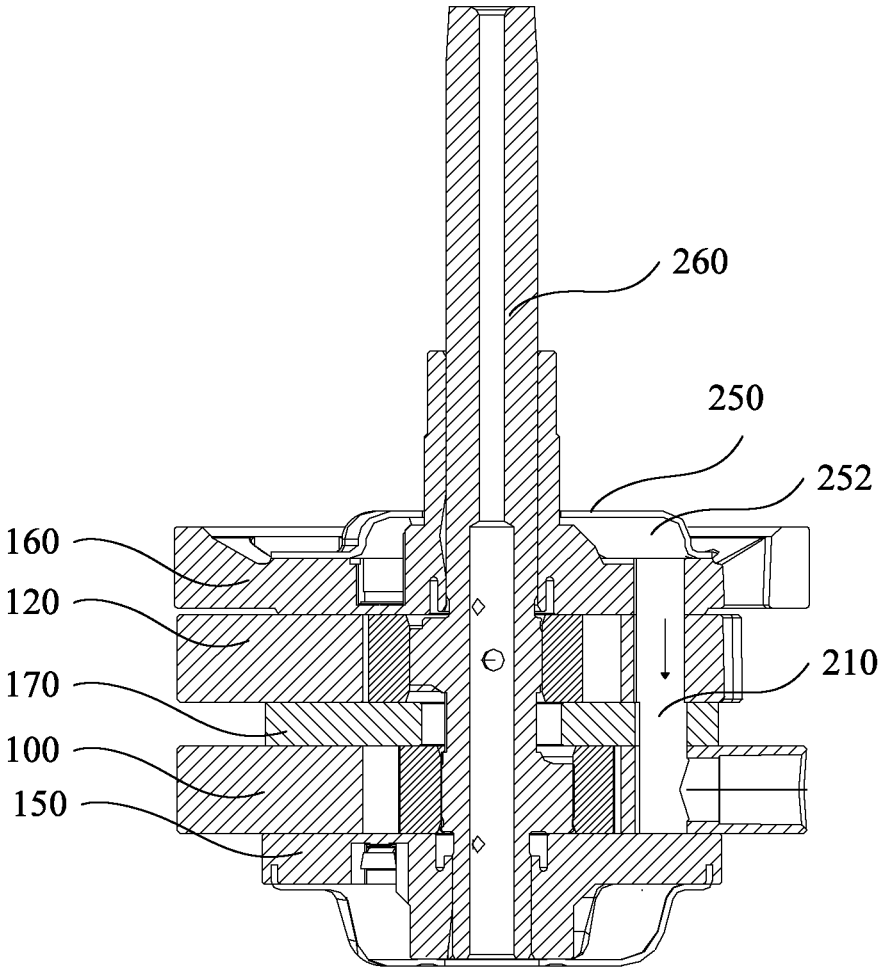
FIG. 8 shows a partial structural diagram of a compressor according to further another embodiment of the present application.
Figure 9:
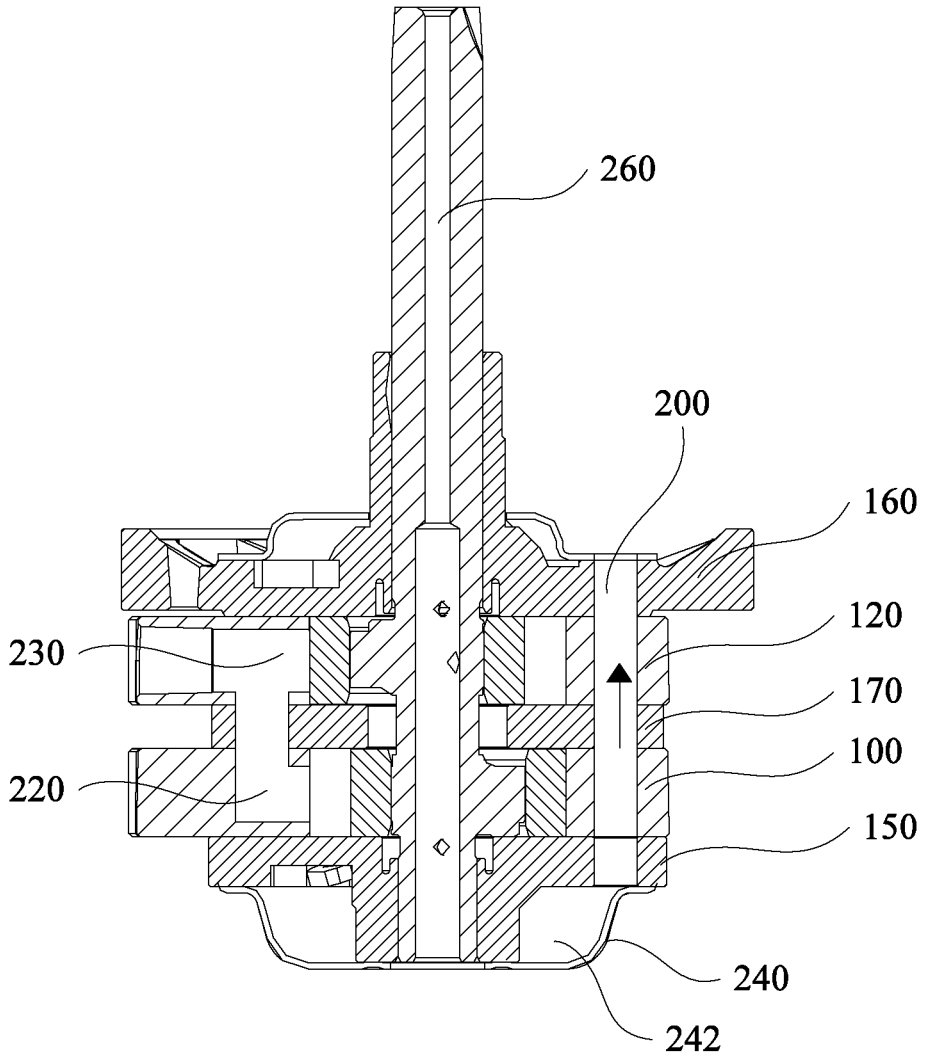
FIG. 9 shows a partial structural diagram of a compressor according to further another embodiment of the present application.

As shown in FIG. 5, FIG. 8 and FIG. 9, in further another exemplary embodiment, the compressor further comprises a first seal 240 and a first air outlet channel 200. The first seal 240 and the first bearing 150 enclose a first exhaust cavity 242, and the first exhaust outlet 180 is communicated with the first exhaust cavity 242; the first air outlet channel 200 penetrates through the first bearing 150, the first cylinder 100, the diaphragm assembly 170, the second cylinder 120 and the second bearing 160 and is communicated with the inner cavity of the housing 140; a second seal 250 and a second air outlet channel 210. The second seal 250 and the second bearing 160 enclose a second exhaust cavity 252, the second exhaust outlet 190 is communicated with the second exhaust cavity 252, the second air outlet channel 210 penetrates through the second bearing 160, the second cylinder 120 and the diaphragm assembly 170 and is communicated with the second air outlet port 144 through an exhaust channel on the first cylinder 100.

In the present embodiment, the compressor further comprises a first seal 240 and a second seal 250. The first seal 240 and the first bearing 150 enclose a first exhaust cavity 242, and the second seal 250 and the second bearing 160 enclose a second exhaust cavity 252. The first working cavity is communicated with the first air outlet channel 200, and the first air outlet channel 200 penetrates through the first bearing 150, the first cylinder 100, the diaphragm assembly 170, the second cylinder 120 and the second bearing 160, and then is communicated with the inner cavity of the housing 140, so that gas in the first working cavity can reach the side where the second cylinder 120 is located through the first air outlet channel 200, and is then diffused into the inner cavity of the housing 140 to communicate with the first air outlet port 142. By communicating the second working cavity with the second air outlet channel 210 which is made to penetrate through the second bearing 160, the second cylinder 120 and the diaphragm assembly 170, and then communicate with the second air outlet port 144 through the exhaust channel on the first cylinder 100, it is realized that gas in the second working cavity moves to the position where the first cylinder 100 is located through the second air outlet channel 210 and is discharged to the second air outlet port 144 through an exhaust channel on the first cylinder 100.

Further, the first seal 240 and the second seal 250 are cover plates or silencers, which are connected at other positions by bolts or welding.

In further another exemplary embodiment, the compressor further comprises a first seal 240 and a second seal 250. The first seal 240 and the first bearing 150 enclose the first exhaust cavity 242, the first working cavity is communicated with the first exhaust cavity 242, the second seal 250 and the second bearing 160 enclose the second exhaust cavity 252, and the second working cavity is communicated with the second exhaust cavity 252. The first air outlet channel 200 penetrates through the first bearing 150, the first cylinder 100 and the diaphragm assembly 170, and is communicated with the second air outlet port 144 through the exhaust channel on the second cylinder 120. The second air outlet channel 210 penetrates through the second bearing 160, the second cylinder 120, the diaphragm assembly 170, the first cylinder 100 and the first bearing 150, and is communicated with the inner cavity of the housing 140.

Further, the compressor further comprises lift limiters disposed on the first bearing 150 and the second bearing 160, which can limit exhaust speeds of the first air outlet channel 200 and the second air outlet channel 210. A first exhaust valve is disposed on the first air outlet channel 200; and a second exhaust valve is disposed on the second air outlet channel 210.

Embodiment 3

Figure 7:
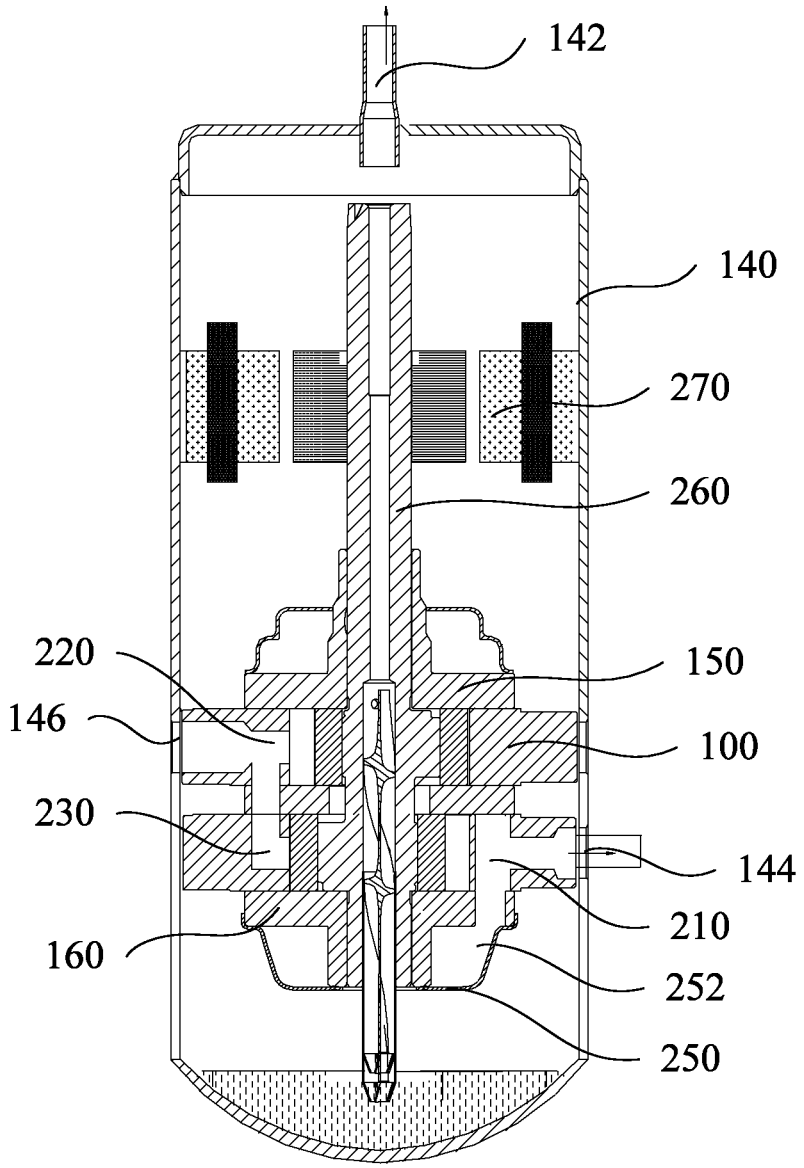
FIG. 7 shows a schematic structural diagram of a compressor according to further another embodiment of the present application.

As shown in FIG. 7, on the basis of Embodiment 2, it is further defined that the housing 140 is provided with an air suction port 146, and the compressor further comprises a first air suction channel 220 and a second air suction channel 230. The first working cavity is communicated with the air suction port 146 through the first air suction channel 220, and the second working cavity is communicated with the air suction port 146 through the second air suction channel 230. Further, the first air suction channel 220 and the second air suction channel 230 are communicated with each other.

In the embodiment, an air suction port 146 may be disposed on the housing 140, so that both the first working cavity and the second working cavity communicate with one air suction port 146. For example, the first working cavity is communicated with the air suction port 146 through a first air suction channel 220, and the second working cavity is communicated with the air suction port 146 through a second air suction channel 230, and the first air suction channel 220 and the second air suction channel 230 are optionally communicated with each other, so that the total length of the air suction channel is reduced, the rigidity is prevented from being influenced by over-machining parts such as cylinders and bearings, and the production cost is reduced.

Embodiment 4

As shown in FIG. 4, on the basis of Embodiment 2, it is further defined that the housing 140 is provided with two air suction port 146, and the compressor further comprises a first air suction channel 220 and a second air suction channel 230. The first working cavity is communicated with one air suction port 146 through the first air suction channel 220, and the second working cavity is communicated with the other air suction port 146 through the second air suction channel 230. Further, the first air suction channel 220 and the second air suction channel 230 do not communicate with each other.

In the present embodiment, by setting the two air suction port 146 on the housing 140 and making one working cavity communicate with one air suction port 146, the gases in the two air suction channels will not be mixed with each other, which is beneficial to ensure the suction amount of each cylinder.

Embodiment 5

On the basis of Embodiment 3 or the Embodiment 4, it is further defined that the first air suction channel 220 is disposed on the first cylinder 100 or the first bearing 150 or the diaphragm assembly 170; and the second air suction channel 230 is disposed on the second cylinder 120 or the second bearing 160 or the diaphragm assembly 170.

Further, the first air suction channel 220 is disposed on the first cylinder 100, and gas enters the first working cavity through the first air suction channel 220 and is compressed in the first working cavity. Similarly, the first air suction channel 220 can also be disposed on the first bearing 150, and the gas enters the first working cavity through the first air suction channel 220 on the first bearing 150, thus realizing the process of sucking the gas into the first working cavity. The second air suction channel 230 is disposed on the second cylinder 120, and the gas enters the second working cavity through the second air suction channel 230 and is compressed in the second working cavity. Similarly, the second air suction channel 230 can also be disposed on the second bearing 160, and the gas enters the second working cavity through the second air suction channel 230 on the second bearing 160, thereby realizing the process of sucking the gas into the second working cavity.

In an exemplary embodiment of the present embodiment, the first air suction channel 220 is disposed on the first cylinder 100, and gas enters the first working cavity through the first air suction channel 220 to realize the process of sucking the gas into the first working cavity; and the second air suction channel 230 is disposed on the second cylinder 120 and is communicated with the second working cavity, and the gas enters the second working cavity through the second air suction channel 230, thereby realizing the process of sucking the gas into the second working cavity.

In another exemplary embodiment, the first air suction channel 220 is disposed on the first cylinder 100 and is communicated with the first working cavity, and gas enters the first working cavity through the first air suction channel 220 to realize the process of sucking the gas into the first working cavity; and the second air suction channel 230 is disposed on the second bearing 160 and is communicated with the second working cavity, and the gas enters the second working cavity through the second air suction channel 230, thereby realizing the process of sucking the gas into the second working cavity.

In yet another exemplary embodiment, the first air suction channel 220 is disposed on the first bearing 150 and is communicated with the first working cavity, and gas enters the first working cavity through the first air suction channel 220, thereby realizing the process of sucking the gas into the first working cavity; and the second air suction channel 230 is disposed on the second cylinder 120, and the gas enters the second working cavity through the second air suction channel 230, thereby realizing the process of sucking the gas into the second working cavity.

In further another exemplary embodiment, the first air suction channel 220 is disposed on the first bearing 150, and gas enters the first working cavity through the first air suction channel 220, thereby realizing the process of sucking the gas into the first working cavity; and the second air suction channel 230 is disposed on the second bearing 160, and the gas enters the second working cavity through the second air suction channel 230, thereby realizing the process of sucking the gas into the second working cavity.

Embodiment 6

On the basis of any of the above embodiments, as shown in FIG. 4 and FIG. 6, it is further defined that the first slide sheet assembly 280 comprises a first slide sheet and a first elastic part. The first slide sheet presses the peripheral surface of the first piston 110, and the first elastic part is connected with the end of the first slide sheet which is far away from the first piston 110, so that the first elastic part can push the first slide sheet to press the peripheral surface of the first piston 110 all the time during the motion of the first piston 110, thus ensuring the tightness of the first working cavity. Or, the first slide sheet assembly 280 comprises a first slide sheet, and the first slide sheet can be integrated with the first piston 110, which can prevent the first slide sheet from falling out of a first slide sheet slot, ensure the stable installation of the first slide sheet, and improve the reliability of the product. Moreover, the integrated structure has good mechanical properties, so the connection strength between the first slide sheet and the first piston 110 can be improved. In addition, the first slide sheet and the first piston 110 are integrally made, which is beneficial to mass production, improves the processing efficiency of the product and reduces the processing cost of the product. Of course, the first slide sheet can also be hinged with the first piston 110, which can also play a role in preventing the first slide sheet from falling out of the first slide sheet slot, thereby stabilizing the installation of the first slide sheet and improving the reliability of the product.

The second slide sheet assembly 290 comprises a second slide sheet and a second elastic part. The second slide sheet presses the peripheral surface of the second piston 130, and the second elastic part is connected with the end of the second slide sheet which is far away from the second piston 130, so that the second elastic part can push the second slide sheet to press the peripheral surface of the second piston 130 all the time during the motion of the second piston 130, thus ensuring the tightness of the second working cavity. Or, the second slide sheet assembly 290 comprises a second slide sheet, and the second slide sheet can be integrated with the second piston 130, which can prevent the second slide sheet from falling out of a second slide sheet slot, ensure the stable installation of the second slide sheet, and improve the reliability of the product. Moreover, the integrated structure has good mechanical properties, so the connection strength between the second slide sheet and the second piston 130 can be improved. In addition, the second slide sheet and the second piston 130 are integrally manufactured, which is beneficial to mass production, improves the processing efficiency of the product and reduces the processing cost of the product. Of course, the second slide sheet can also be hinged with the second piston 130, which can also play a role in preventing the second slide sheet from falling out of the second slide sheet slot, thereby stabilizing the installation of the second slide sheet and improving the reliability of the product.

Embodiment 7

As shown in FIG. 1 and FIG. 4, on the basis of any of the above embodiments, it is further defined that the compressor further comprises a crankshaft 260 and a motor assembly 270. The motor assembly 270 comprises a stator and a rotor, the crankshaft 260 comprises a first eccentric part and a second eccentric part, the first piston 110 is connected with the first eccentric part, and the second piston 130 is connected with the second eccentric part; and a motor assembly 270 which is connected with the crankshaft 260 to drive the crankshaft 260 to rotate.

The compressor further comprises a crankshaft 260 and a motor assembly 270. The motor assembly 270 can drive the crankshaft 260 to rotate. The crankshaft 260 comprises a first eccentric part connected with the first piston 110 and a second eccentric part connected with the second piston 130. When the crankshaft 260 rotates, the first eccentric part on the crankshaft 260 drives the first piston 110 to rotate, and the rotating first piston 110 can realize the functions of sucking, compressing and discharging gas.

The second eccentric part on the crankshaft 260 drives the second piston 130 to rotate, and the rotating second piston 130 realizes the functions of sucking, compressing and discharging gas.

As the crankshaft 260 drives the first piston 110 and the second piston 130 to rotate, a stream of low-pressure gas enters the first working cavity of the first cylinder 100 from the first air suction channel 220, and the processes of air suction, air compression and gas exhausting are completed in the first working cavity, and then the gas is exhausted through the first air outlet channel 200. Another stream of low-pressure gas enters the second working cavity of the second cylinder 120 through the second air suction channel 230, and the processes of air suction, air compression and gas exhausting are completed in the second working cavity, and the gas is exhausted through the second air outlet channel 210, and the exhausting process is completed twice per revolution of the crankshaft 260.

The embodiments of the second aspect of the present application provides refrigeration device, which comprises a compressor in any of the above embodiments, so the refrigeration device provided by the present application has all the benefits of the compressor provided in any of the above embodiments.

Figure 10:
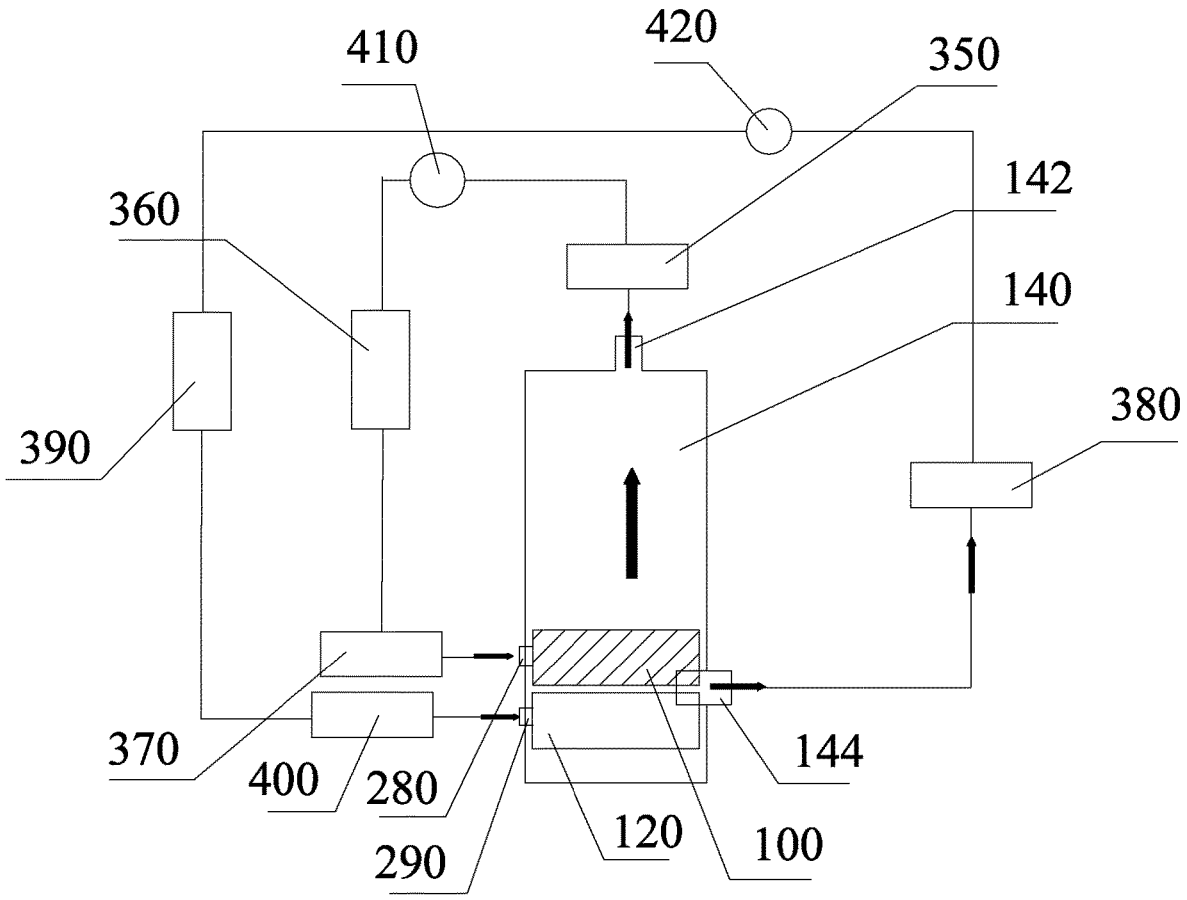
FIG. 10 shows a schematic structural diagram of refrigeration device according to an embodiment of the present application.

As shown in FIG. 10, in an exemplary embodiment, the refrigeration device further comprises a first condenser 350, a first throttling part 410, a first evaporator 360, a first reservoir 370, a second condenser 380, a second throttling part 420, a second evaporator 390 and a second reservoir 400.

The first condenser 350 is communicated with the first air outlet port 142 of the compressor, the first throttling part 410 is communicated with the first condenser 350, the first evaporator 360 is communicated with the first throttling part 410, and the first reservoir 370 is communicated with the first evaporator 360 and the first air suction channel 220 of the compressor.

The second condenser 380 is communicated with the second air outlet port 144 of the compressor, the second throttling part 420 is communicated with the second condenser 380, the second evaporator 390 is communicated with the second throttling part 420, and the second reservoir 400 is communicated with the second evaporator 390 and the second air suction channel 230 of the compressor.

The compressor, the first condenser 350, the first throttling part 410, the first evaporator 360 and the first reservoir 370 form a first set of refrigeration system, while the compressor, the second condenser 380, the second throttling part 420, the second evaporator 390 and the second reservoir 400 form a second set of refrigeration system. The two independent refrigeration systems, i.e., the refrigeration device realizes multi-exhaust functions realized by multiple compressors in related arts through one compressor, which reduces the processing cost of the refrigeration device and also reduces the occupied space of refrigeration device, and improves the convenience of installing internal components of refrigeration device. Due to the different exhaust pressures of the first cylinder 100 and the second cylinder 120, the exhaust pressures reaching the first condenser 350 and the second condenser 380 are different, which can make the refrigeration device have double condensation temperatures and double evaporation temperatures. It is beneficial to realize cascade utilization of energy and improving the energy efficiency of refrigeration device. Especially, under the condition that the displacements of the first cylinder 100 and the second cylinder 120 are different, the amounts of a refrigerant condensed by the first condenser 350 and the second condenser 380 are different, and the energy efficiency of refrigeration device is further improved.

The flow process of the refrigerant is as follows:

The first air outlet port 142 of the compressor is connected with the first condenser 350 through pipes and other components, and the refrigerant flows into the first evaporator 360 through the first expansion valve, from which it flows into the first air suction channel 220 of the first cylinder 100 through the air suction channel of the first reservoir 370. The first air outlet port 142 is connected with the second condenser 380 through a pipe assembly, and the refrigerant flows into the second evaporator 390 through the second expansion valve, and then flows from the second evaporator 390 to the second air suction channel 230 of the second cylinder 120 through the air suction channel of the second reservoir 400.

Figure 11:
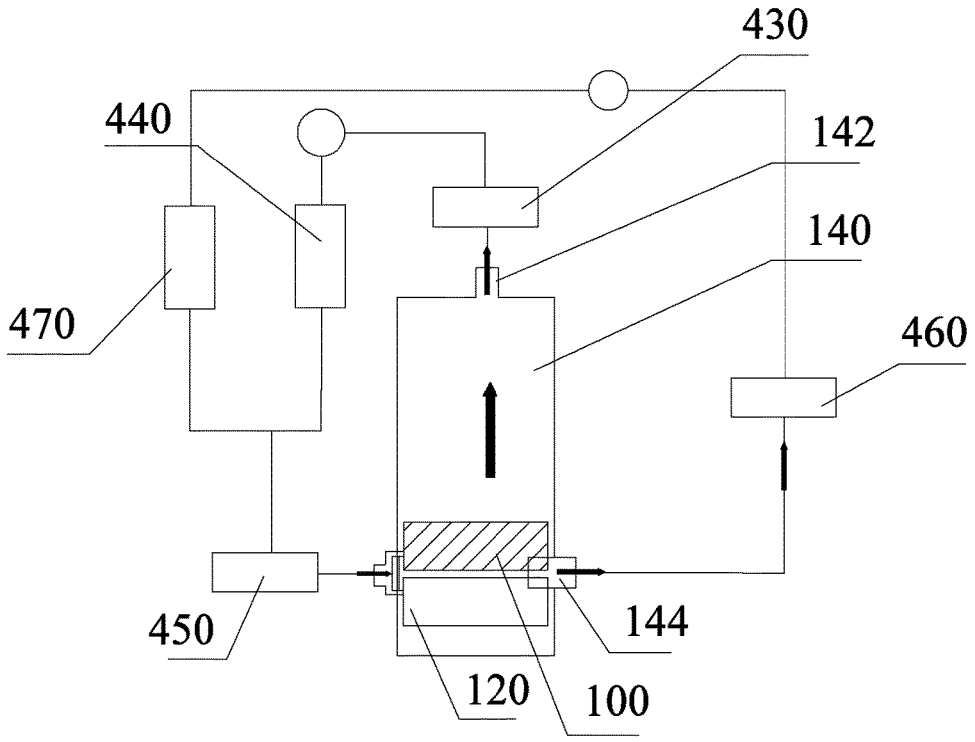
FIG. 11 shows a schematic structural diagram of refrigeration device according to another embodiment of the present application.

As shown in FIG. 11, in another exemplary embodiment, the refrigeration device further comprises a third condenser 430, a third throttling part, a third evaporator 440, a third reservoir 450, a fourth condenser 460, a fourth throttling part and a fourth evaporator 470.

The third condenser 430 is communicated with the first air outlet port 142 of the compressor, the third throttling part is communicated with the third condenser 430, the third evaporator 440 is communicated with the third throttling part, and the third reservoir 450 is communicated with the third evaporator 440 and the first air suction channel 220 and the second air suction channel 230 of the compressor.

The fourth condenser 460 is communicated with the second air outlet port 144 of the compressor, the fourth throttling part is communicated with the fourth condenser 460, the fourth evaporator 470 is communicated with the fourth throttling part, and the third reservoir 450 also is communicated with the fourth evaporator 470 and the first air suction channel 220 and the second air suction channel 230 of the compressor.

The compressor, the third condenser 430, the third throttling part, the third evaporator 440 and the third reservoir 450 form a third set of refrigeration system, while the compressor, the fourth condenser 460, the fourth throttling part, the fourth evaporator 470 and the third reservoir 450 form a fourth set of refrigeration system. The two independent refrigeration systems, i.e., the refrigeration device realizes the multi-exhaust function realized by multiple compressors in related arts through one compressor, which reduces the processing cost of the refrigeration device and also reduces the occupied space of refrigeration device, and improves the convenience of installing internal components of refrigeration device. The first air suction channel 220 and the second air suction channel 230 communicate with the third reservoir 450, so that arrangement of one reservoir can meet the suction functions of the first cylinder 100 and the second cylinder 120, the number of components in the refrigeration device is reduced, the processing cost of the refrigeration device is further reduced, the volume of the refrigeration device is effectively reduced, and the convenience in the installation of the refrigeration device is increased. Furthermore, due to the different exhaust pressures of the first cylinder 100 and the second cylinder 120, the exhaust pressures reaching the third condenser 430 and the fourth condenser 460 are different, which can make the refrigeration device have double condensation temperatures and double evaporation temperatures, which is beneficial to realizing the cascade utilization of energy and improving the energy efficiency of the refrigeration device. Especially, under the condition that the displacements of the first cylinder 100 and the second cylinder 120 are different, the amounts of refrigerant condensed by the third condenser 430 and the fourth condenser 460 are different, and the energy efficiency of the refrigeration device is further improved.

The above two exemplary embodiments realize the function of double exhaust parameters of a single compressor, and effectively save energy consumption by using double exhausting of heat at high and low temperatures. Meanwhile, the range of a parameter ratio of two cylinders is reasonably specified, which can give full play to advantages of double-exhaust circulation and improve energy efficiency.

In the present application, the term "a plurality of" means two or more, unless otherwise specifically regulated. Terms such as "installation", "connected", "connecting", "fixation" and the like shall be understood in broad sense, and for example, "connecting" may refer to fixed connection or detachable connection or integral connection, and "connected" may refer to direct connection or indirect connection through an intermediate medium. For those ordinary skilled in the art, the specific meanings of the above terms in the present application may be understood according to concrete conditions.

In the illustration of this description, the illustration of terms of "one embodiment", "some embodiments", "specific embodiments", etc. means that specific features, structures, materials or characteristics illustrated in combination with the embodiment or example are included in at least one embodiment or example of the present application. In this description, exemplary statements for the above terms shall not necessarily refer to the same embodiment or example. Moreover, the described specific features, structures, materials or characteristics can be combined appropriately in any one or more embodiments or examples.

The above only describes preferred embodiments of the present application and is not intended to limit the present application. For those skilled in the art, various variations and changes can be made to the present application. Any modification, equivalent replacement, improvement, etc. made within the spirit and the principle of the present application shall be included within the protection scope of the present application.

What is claimed is:

1. A compressor comprising:

a housing, wherein a first air outlet port and a second air outlet port not in communication with each other are disposed in the housing;

a first cylinder and a first piston, wherein the first cylinder is provided with a first accommodating cavity, and the first piston is eccentrically disposed in the first accommodating cavity; and a second cylinder and a second piston, wherein the second cylinder is provided with a second accommodating cavity, and the second piston is eccentrically disposed in the second accommodating cavity, wherein:

an inner diameter of the first cylinder is D1, an eccentric distance of the first piston relative to the first accommodating cavity is e1, a height of the first cylinder is H1, and an exhaust pressure of the first cylinder is P1, and the first cylinder is configured to exhaust gas through the first air outlet port;

an inner diameter of the second cylinder is D2, an eccentric distance of the second piston relative to the second accommodation cavity is e2, a height of the second cylinder is H2, and an exhaust pressure of the second cylinder is P2, and the second cylinder is configured to exhaust gas through the second air outlet port; and $P1<P2$, $0.6\leq(e1\times(D1-e1)\times H1)\div(e2\times(D2-e2)\times H2)\leq 1.9$.

2. The compressor according to claim 1, further comprising:

a first bearing and a second bearing, wherein the first bearing and the second bearing are distributed at an interval, and the first cylinder and the second cylinder are positioned between the first bearing and the second bearing;

a diaphragm assembly located between the first cylinder and the second cylinder;

a first slide sheet assembly disposed in the first accommodating cavity, wherein the first slide sheet assembly, a peripheral surface of the first piston and an inner surface of the first cylinder enclose a first working cavity;

a second slide sheet assembly disposed in the second accommodating cavity, wherein the second slide sheet assembly, a peripheral surface of the second piston and an inner surface of the second cylinder enclose a second working cavity; and a first exhaust outlet and a second exhaust outlet, wherein the first working cavity is communicated with the first air outlet port through the first exhaust outlet, and the second working cavity is communicated with the second air outlet port through the second exhaust outlet.

3. The compressor according to claim 2, wherein:

the first exhaust outlet is disposed on the first cylinder or the first bearing or the diaphragm assembly;

the second exhaust outlet is disposed on the second cylinder or the second bearing or the diaphragm assembly; and the first exhaust outlet is communicated with the first air outlet port through an inner cavity of the housing, or the second exhaust outlet is communicated with the second air outlet port through the inner cavity of the housing.

4. The compressor according to claim 2, further comprising:

a first seal and a first air outlet channel, wherein the first seal and the first bearing enclose a first exhaust cavity, the first exhaust outlet is communicated with the first exhaust cavity and the first air outlet channel penetrates through the first bearing, the first cylinder, the diaphragm assembly, the second cylinder and the second bearing and is communicated with an inner cavity of the housing; and a second seal and a second air outlet channel, wherein the second seal and the second bearing enclose a second exhaust cavity, the second exhaust outlet is communicated with the second exhaust cavity, the second air outlet channel penetrates through the second bearing, the second cylinder and the diaphragm assembly and is communicated with the second air outlet port through an exhaust channel on the first cylinder.

5. The compressor according to claim 4, further comprising:

a first exhaust valve disposed on the first air outlet channel; and a second exhaust valve disposed on the second air outlet channel.

6. The compressor according to claim 2, wherein:

the housing is provided with an air suction port, and the compressor further comprises a first air suction channel and a second air suction channel; the first working cavity is communicated with the air suction port through the first air suction channel, and the second working cavity is communicated with the air suction port through the second air suction channel; and the first air suction channel and the second air suction channel are communicated with each other; and/or the housing is provided with two air suction ports, and the compressor further comprises a first air suction channel and a second air suction channel; the first working cavity is communicated with one air suction port through the first air suction channel, and the second working cavity is communicated with the other air suction port through the second air suction channel; and the first air suction channel and the second air suction channel do not communicate with each other.

7. The compressor according to claim 6, wherein:

the first air suction channel is disposed on the first cylinder or the first bearing or the diaphragm assembly; and the second air suction channel is disposed on the second cylinder or the second bearing or the diaphragm assembly.

8. The compressor according to claim 2, wherein:

the first slide sheet assembly comprises a first slide sheet and a first elastic part, and the first elastic part is used for pushing the first slide sheet to press the peripheral surface of the first piston; or the first slide sheet assembly comprises a first slide sheet, and the first slide sheet and the first piston are in an integrated structure; or the first slide sheet and the first piston are hinged; and the second slide sheet assembly comprises a second slide sheet and a second elastic part, and the second elastic part is used for pushing the second slide sheet to press the peripheral surface of the second piston; or the second slide sheet assembly comprises a second slide sheet, and the second slide sheet and the second piston are in an integrated structure or the second slide sheet and the second piston are hinged.

9. The compressor according to claim 1, further comprising:

a crankshaft with a first eccentric part and a second eccentric part, wherein the first piston is connected with the first eccentric part and the second piston is connected with the second eccentric part; and a motor assembly which is connected with the crankshaft to drive the crankshaft to rotate.

10. A refrigeration device comprising the compressor according to claim 6.

11. The refrigeration device according to claim 10, further comprising:

a first condenser communicated with the first air outlet port of the compressor;

a first throttling part communicated with the first condenser;

a first evaporator communicated with the first throttling part;

a first reservoir communicated with the first evaporator and the first air suction channel of the compressor;

a second condenser communicated with a second air outlet port of the compressor;

a second throttling part communicated with the second condenser;

a second evaporator communicated with the second throttling part; and a second reservoir communicated with the second evaporator and the second air suction channel of the compressor.

12. The refrigeration device according to claim 10, further comprising:

a third condenser communicated with the first air outlet port of the compressor;

a third throttling part communicated with the third condenser;

a third evaporator communicated with the third throttling part;

a third reservoir communicating the first air suction channel and the second air suction channel of the third evaporator and the compressor;

a fourth condenser communicated with the second air outlet port of the compressor;

a fourth throttling part communicated with the fourth condenser; and a fourth evaporator communicated with the fourth throttling part, wherein the third reservoir is also communicated with the first air suction channel and the second air suction channel of the fourth evaporator and the compressor.

13. A refrigeration device comprising the compressor according to claim 1.

* * * * *